US007354131B2

(12) United States Patent
Patil

(10) Patent No.: US 7,354,131 B2
(45) Date of Patent: Apr. 8, 2008

(54) INKJET PRINTHEAD NOZZLE PLATE

(75) Inventor: Girish S. Patil, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 647 days.

(21) Appl. No.: 10/878,183

(22) Filed: Jun. 28, 2004

(65) Prior Publication Data

US 2004/0233240 A1 Nov. 25, 2004

Related U.S. Application Data

(62) Division of application No. 10/422,153, filed on Apr. 24, 2003, now Pat. No. 6,773,869.

(51) Int. Cl.
*B41J 2/015* (2006.01)

(52) U.S. Cl. ..... 347/20; 347/63

(58) Field of Classification Search ..... 347/20, 347/47, 56, 61–65, 67, 44, 54
See application file for complete search history.

(56) References Cited

U.S. PATENT DOCUMENTS

| | | | | |
|---|---|---|---|---|
| 4,104,070 A | | 8/1978 | Moritz et al. | 430/329 |
| 4,394,670 A | | 7/1983 | Sugitani et al. | 347/65 |
| 4,509,063 A | | 4/1985 | Sugitani et al. | 347/65 |
| 4,558,333 A | * | 12/1985 | Sugitani et al. | 347/65 |
| 4,564,584 A | | 1/1986 | Fredericks et al. | 430/312 |
| 4,567,132 A | | 1/1986 | Fredericks et al. | 430/312 |
| 5,126,768 A | | 6/1992 | Nozawa et al. | 347/65 |
| 5,331,344 A | | 7/1994 | Miyagawa et al. | 347/65 |
| 5,334,999 A | | 8/1994 | Kashiwazaki et al. | 347/65 |
| 5,663,752 A | | 9/1997 | Imamura et al. | 430/320 |
| 5,686,224 A | | 11/1997 | O'Neil | 347/65 |
| 5,730,889 A | | 3/1998 | Miyagawa et al. | 216/27 |
| 5,983,486 A | | 11/1999 | Shimomura et al. | 29/611 |
| 6,676,246 B1 | * | 1/2004 | Anderson et al. | 347/62 |

FOREIGN PATENT DOCUMENTS

| | | |
|---|---|---|
| EP | 0 450 869 A2 | 10/1991 |
| EP | 0 488 675 A1 | 6/1992 |
| GB | 2092960 A | 8/1982 |
| JP | 4-216953 A | 8/1992 |

OTHER PUBLICATIONS

Combined Search and Examination Report under Sections 17 and 18(3), Nov. 16, 2006, The [UK] Patent Office, The United Kingdom.

* cited by examiner

*Primary Examiner*—Juanita D. Stephens
(74) *Attorney, Agent, or Firm*—King & Schickli, PLLC

(57) ABSTRACT

Methods of forming a nozzle plate include forming a first reverse imageable positive photoresist layer on the substrate and protecting an area thereof adjacent an ink ejection element from ultraviolet energy while exposing other than the protected area to such energy. Thereafter, the non-protected area is rendered insoluble by heating. Thereafter, the protected area is exposed to ultraviolet energy to weaken its structure for later removal. A second reverse imageable positive resist layer gets formed on the first layer and exposed to ultraviolet energy in a region directly above the ink ejection element. In a single step, both the protected area of the first layer and the non-protected region of the second layer are removed to form an ink flow feature, a bubble chamber or an orifice of the nozzle plate. The remainders of the first and second layers become blanket exposed to ultraviolet energy and cured in place.

20 Claims, 6 Drawing Sheets

INKJET PRINTHEAD NOZZLE PLATE

This application claims priority and benefit as a divisional application of U.S. patent application Ser. No. 10/422,153 filed on Apr. 24, 2003, now U.S. Pat. No. 6,773,869.

FIELD OF THE INVENTION

The present invention relates to inkjet printheads. In particular, it relates to a nozzle plate thereof formed with at least two positive photoresist layers that undergo a single removal of unwanted photoresist materials.

BACKGROUND OF THE INVENTION

The art of inkjet printing is relatively well known. In general, an image is produced by emitting ink drops from a printhead at precise moments such that they impact a print medium at a desired location. The printhead is supported by a movable print carriage within a device, such as an inkjet printer, and is caused to reciprocate relative to an advancing print medium and emit ink drops at times pursuant to commands of a microprocessor or other controller. The timing of the ink drop emissions corresponds to a pattern of pixels of the image being printed. Other than printers, familiar devices incorporating inkjet technology include fax machines, all-in-ones, photo printers, and graphics plotters, to name a few.

A conventional thermal inkjet printhead includes access to a local or remote supply of color or mono ink, a heater chip, a nozzle or orifice plate attached or formed with the heater chip, and an input/output connector, such as a tape automated bond (TAB) circuit, for electrically connecting the heater chip to the printer during use. The heater chip, in turn, typically includes a plurality of thin film resistors or heater elements fabricated by deposition, masking and etching techniques on a substrate such as silicon.

To print or emit a single drop of ink, an individual heater is uniquely addressed with a predetermined amount of current to rapidly heat a small volume of ink. This causes the ink to vaporize in a local bubble chamber (between the heater and nozzle plate) and be ejected through the nozzle plate towards the print medium.

Typically, nozzle plates that attach to the heater chip, post-chip-formation, have certain economic and mechanical drawbacks relating to the alignment between the nozzle plate orifices and the heater elements. As is known, poor alignment causes product defects or ineffectiveness. On the other hand, nozzle plates concurrently formed with the heater chip often suffer deformations in ink flow features or nozzle orifice shapes upon subsequent chip processing steps. Again, product defects or ineffectiveness can result. In addition, concurrently formed nozzle plates often require multiple solvent dissolving/removal steps which add cost and complexity to the fabrication sequence.

Accordingly, a need exists in the nozzle plate art for economic and simple designs that overcome misalignment and malformation and require minimal processing steps.

SUMMARY OF THE INVENTION

The above-mentioned and other problems become solved by applying the principles and teachings associated with the hereinafter described inkjet printhead having a nozzle plate formed with at least two positive acting photoresist layers.

In one embodiment, the invention teaches a nozzle plate for a substrate made by initially forming a first reverse imageable positive photoresist layer on the substrate. In an area thereof adjacent an ink ejection element, the first layer is protected from energy rays while areas other than the protected area are subjected to such energy. The non-protected area is heated to cross-link it and make it substantially insoluble. Thereafter, energy rays expose the protected area to weaken its composition for later removal. A second reverse imageable positive resist layer gets formed on the first layer and, in a region directly above the ink ejection element, is exposed to energy rays. Subsequently, both the protected area of the first layer and the non-protected region of the second layer are removed in a single processing step by an alkaline solvent. This forms an ink flow feature, a bubble chamber and/or a nozzle orifice of the nozzle plate. Finally, the remaining portions of the first and second layers are blanket exposed to energy rays and heated to cure them in place.

In other aspects of the invention, the layers become formed by spin casting a solution or laminating a dry film of positive photoresist material directly on the substrate containing ink ejection elements. Exposure of the layers to energy rays, such as ultraviolet radiation, followed by heat, leads to cross-linking of the layers in specific patterns consistent with a pattern of a photomask.

Inkjet printers and inkjet printheads are also disclosed.

These and other embodiments, aspects, advantages, and features of the present invention will be set forth in the description which follows, and in part will become apparent to those of ordinary skill in the art by reference to the following description of the invention and referenced drawings or by practice of the invention. The aspects, advantages, and features of the invention are realized and attained by means of the instrumentalities, procedures, and combinations particularly pointed out in the appended claims.

DETAILED DESCRIPTION OF THE PREFERRED EMBODIMENTS

In the following detailed description of the preferred embodiments, reference is made to the accompanying drawings that form a part hereof, and in which is shown by way of illustration, specific embodiments in which the inventions may be practiced. These embodiments are described in sufficient detail to enable those skilled in the art to practice the invention, and it is to be understood that other embodiments may be utilized and that process or other changes may be made without departing from the scope of the present invention. The following detailed description is, therefore, not to be taken in a limiting sense and the scope of the present invention is defined only by the appended claims and their equivalents. In accordance with the present invention, an inkjet printhead having a nozzle plate formed of two positive resist layers in a sequence of exposure, heating and removal processing steps is hereinafter described.

Figure 1:
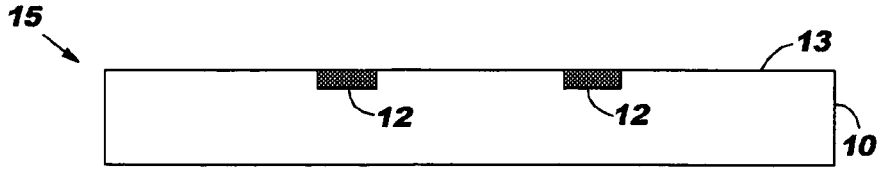
FIG. 1 is a diagrammatic cross-section view in accordance with the teachings of the present invention of an inkjet printhead wafer with an ink ejection element.
Figure 3:
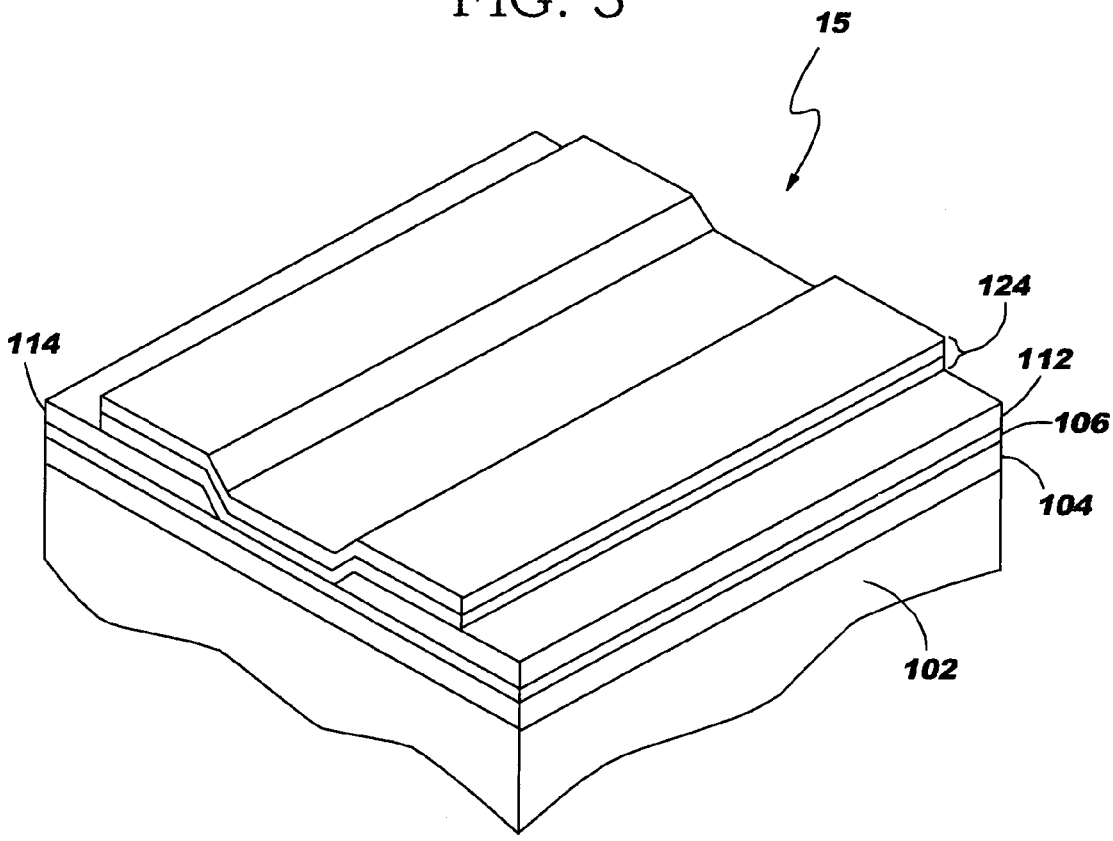
FIG. 3 is a perspective view in accordance with the teachings of the present invention of an individual ink ejection element of a heater chip.

With reference to FIG. 3, and appreciating that an individual ink ejection element is one of many ink ejection elements on a heater chip, skilled artisans know the economy of scale achieved by fabricating ink ejection elements as thin film layers on a wafer or a substrate through a series of growth layers, deposition layers, masking, patterning, photolithography, and/or etching or other processing steps. In general, the thin film layers of a heater chip 15 include, but are not limited to: a base substrate 102 (including any base semiconductor structure such as silicon-on-sapphire (SOS) technology, silicon-on-insulator (SOI) technology, thin film transistor (TFT) technology, doped and undoped semiconductors, epitaxial layers of silicon supported by a base semiconductor structure, as well as other semiconductor structures known or hereinafter developed); a thermal barrier layer 104 on the substrate; a heater or resistor layer 106 on the thermal barrier layer; a conductor layer (bifurcated into positive 112 and negative 114 electrode sections, i.e., anodes and cathodes) on the resistor layer to heat the resistor layer through thermal conductivity during use; passivation layer(s) 124, such as SiC and/or SiN; and an overlying cavitation layer (not shown) on the passivation layer(s). By incorporation by reference, co-pending application Ser. No. 10/146,578, entitled "Heater Chip Configuration for an Inkjet Printhead and Printer," filed May 14, 2002 and having common assignee, teaches suitable layers, thicknesses, compositions and stable ink jetting energy ranges relevant to the instant invention. For simplicity, FIG. 1 shows the heater chip 15 of the invention as a wafer or substrate 10 containing at least one ink ejection element 12 for ejecting ink from an attendant inkjet printhead during use.

As is known, various methods for processing the thin film layers include, but are not limited to, any variety of chemical vapor depositions (CVD), physical vapor depositions (PVD), epitaxy, ion beam deposition, evaporation, sputtering or other similarly known techniques. Preferred CVD techniques include low pressure (LP), atmospheric pressure (AP), plasma enhanced (PE), high density plasma (HDP) or other. Preferred etching techniques include, but are not limited to, any variety of wet or dry etches, reactive ion etches, deep reactive ion etches, etc. Preferred photolithography steps include, but are not limited to, exposure to ultraviolet or x-ray light sources, or other known or hereinafter developed technologies.

In still other embodiments, the substrate itself comprises a silicon wafer of p-type, 100 orientation, having a resistivity of 5-20 ohm/cm. Its beginning thickness is preferably, but not necessarily required, any one of 525+/−20 microns, 625+/−20 microns, or 625+/−15 microns with respective wafer diameters of 100+/−0.50 mm, 125+/−0.50 mm, and 150+/−0.50 mm.

The thermal barrier layer overlying the substrate includes a silicon oxide layer mixed with a glass such as BPSG, PSG or PSOG with an exemplary thickness of about 0.5 to about 3 microns, especially 1.82+/−0.15 microns. This layer can be deposited or grown according to manufacturing preference.

The heater element layer on the thermal barrier layer is about a 50-50% tantalum-aluminum composition layer of about 900 or 1000 angstroms thick. In other embodiments, the resistor layer includes essentially pure or composition layers of any of the following: hafnium, Hf, tantalum, Ta, titanium, Ti, tungsten, W, hafnium-diboride, $HfB_2$, Tantalum-nitride, $Ta_2N$, TaAl(N,O), TaAlSi, TaSiC, Ta/TaAl layered resistor, Ti(N,O), WSi(O) and the like.

The conductor layer overlying portions of the heater layer includes an anode and a cathode with about a 99.5-0.5% aluminum-copper composition of about 5000+/−10% angstroms thick. In other embodiments, the conductor layer includes pure aluminum or diluted compositions of aluminum with 2% copper or aluminum with 4% copper.

Figure 4:
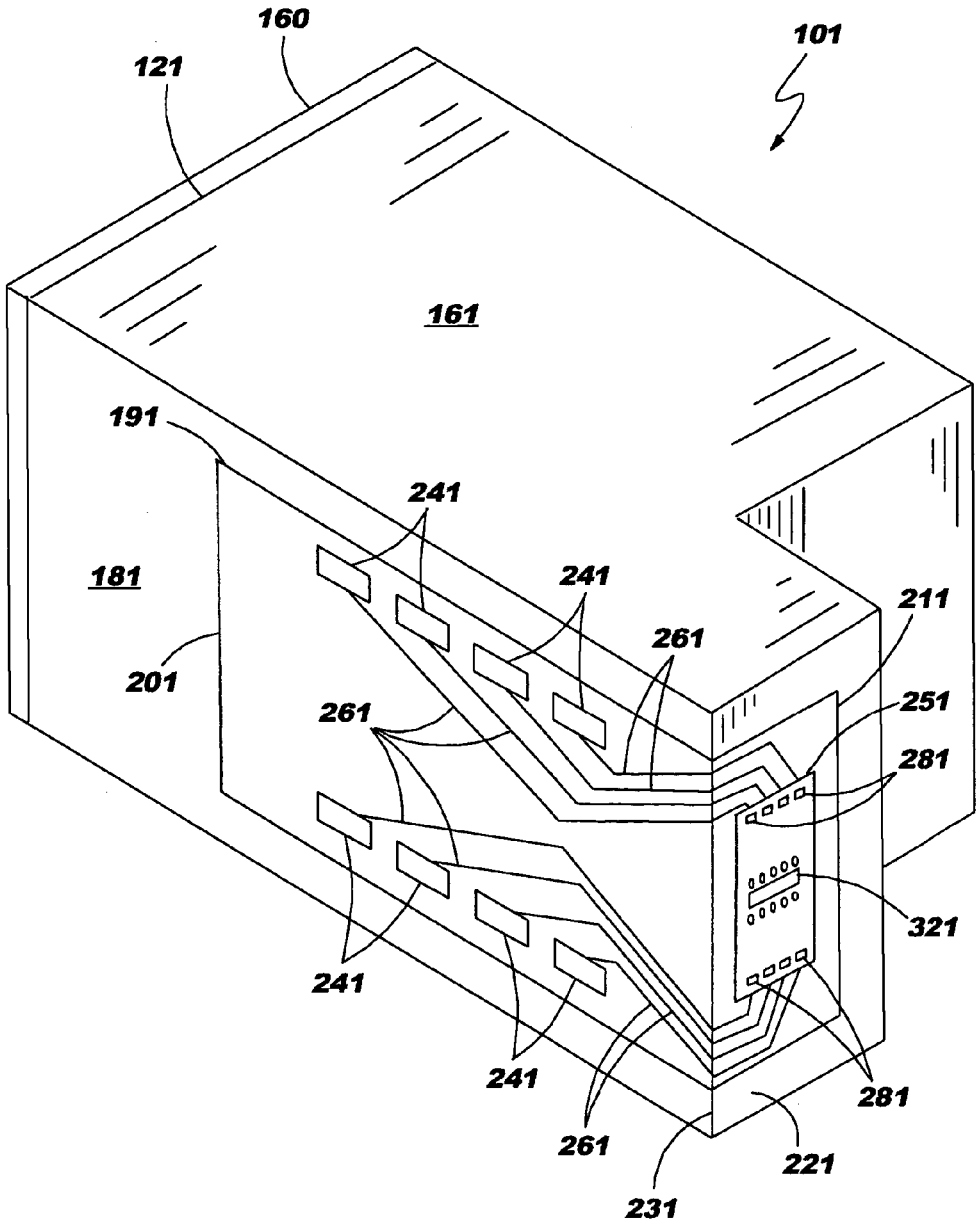
FIG. 4 is a perspective view of an inkjet printhead with a heater chip having a nozzle plate formed in accordance with the teachings of the present invention.

With reference to FIG. 4, an inkjet printhead of the present invention for housing the heater chip is shown generally as 101. The printhead 101 has a housing 121 formed of a body 161 and a lid 160. Although shown generally as a rectangular solid, the housing shape varies and depends upon the external device that carries or contains the printhead. The housing has at least one compartment, internal thereto, for holding an initial or refillable supply of ink and a structure, such as a foam insert, lung or other, maintains an appropriate backpressure therein during use. In another embodiment, the internal compartment includes three chambers for containing three supplies of ink, especially cyan, magenta and yellow ink. In other embodiments, the compartment may contain black ink, photo-ink and/or plurals of cyan, magenta or yellow ink. It will be appreciated that fluid connections (not shown) may exist to connect the compartment(s) to a remote source of ink.

A portion 191 of a tape automated bond (TAB) circuit 201 adheres to one surface 181 of the housing while another portion 211 adheres to another surface 221. As shown, the two surfaces 181, 221 exist substantially perpendicularly to one another about an edge 231.

The TAB circuit 201 has a plurality of input/output (I/O) connectors 241 fabricated thereon for electrically connecting a heater chip 251 to an external device, such as a printer, fax machine, copier, photo-printer, plotter, all-in-one, etc., during use. Pluralities of electrical conductors 261 exist on the TAB circuit 201 to electrically connect and short the I/O connectors 241 to the bond pads 281 of the heater chip 251 and various manufacturing techniques are known for facilitating such connections. Skilled artisans should appreciate that while eight I/O connectors 241, eight electrical conductors 261 and eight bond pads 281 are shown, any number are possible and the invention embraces all variations. The invention also embraces embodiments where the number of connectors, conductors and bond pads do not equal one another.

The heater chip 251 contains at least one ink via 321 that fluidly connects the heater chip to a supply of ink internal to the housing. During printhead manufacture, the heater chip 251 preferably attaches to the housing with any of a variety of adhesives, epoxies, etc. well known in the art. As shown, the heater chip contains two columns of ink ejection elements on either side of via 321. For simplicity in this crowded figure, dots or small circles depict the ink ejection elements in the columns. In an actual printhead, hundreds or thousands of ink ejection elements may be found on the printhead and may have various vertical and horizontal alignments, offsets or other. A nozzle plate, to be described below, is formed over and concurrently with the heater chip such that the nozzle orifices align with the ink ejection elements.

Figure 5:
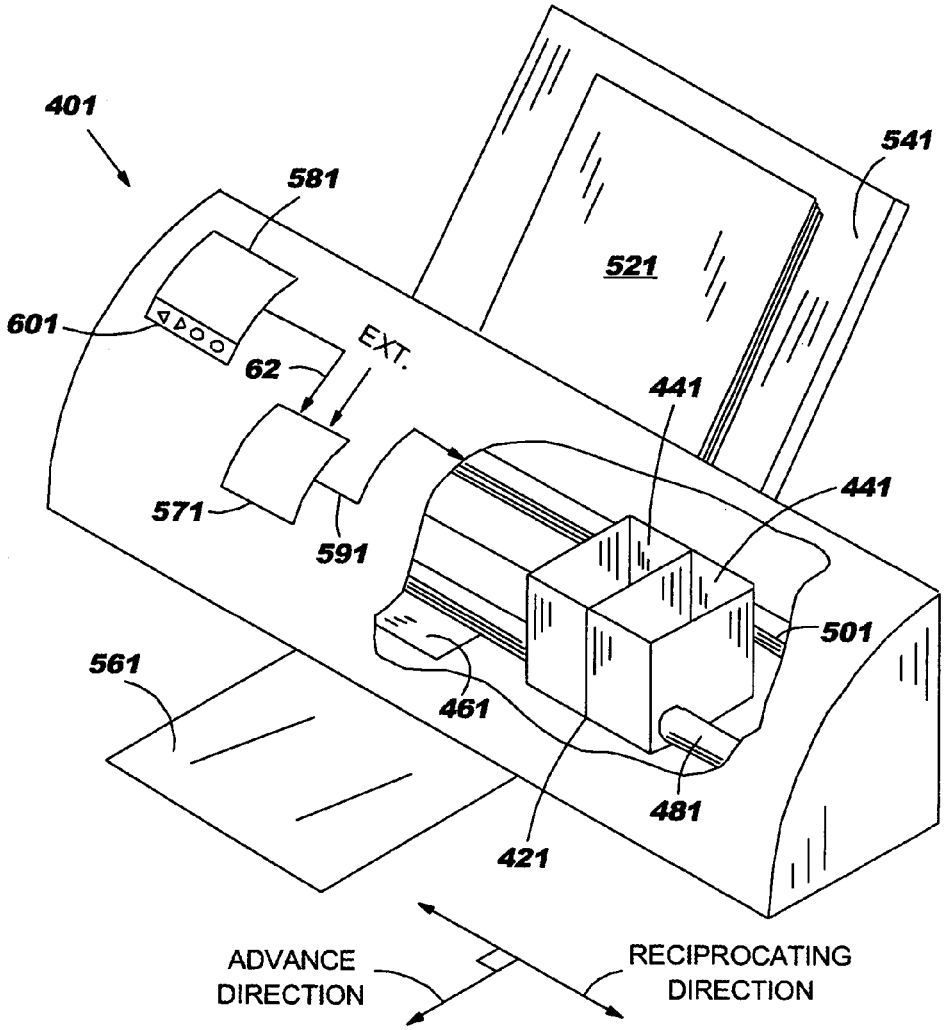
FIG. 5 is a perspective view of an inkjet printer for housing an inkjet printhead with a heater chip and nozzle plate formed in accordance with the teachings of the present invention.

With reference to FIG. 5, an external device in the form of an inkjet printer contains the printhead 101 and is shown generally as 401. The printer 401 includes a carriage 421 having a plurality of slots 441 for containing one or more printheads. The carriage 421 is caused to reciprocate (via an output 591 of a controller 571) along a shaft 481 above a print zone 461 by a motive force supplied to a drive belt 501 as is well known in the art. The reciprocation of the carriage 421 is performed relative to a print medium, such as a sheet of paper 521, that is advanced in the printer 401 along a paper path from an input tray 541, through the print zone 461, to an output tray 561.

In the print zone, the carriage 421 reciprocates in the Reciprocating Direction generally perpendicularly to the paper Advance Direction as shown by the arrows. Ink drops from the printheads (FIG. 4) are caused to be ejected from the heater chip at such times pursuant to commands of a printer microprocessor or other controller 571. The timing of the ink drop emissions corresponds to a pattern of pixels of the image being printed. Often times, such patterns are generated in devices electrically connected to the controller (via Ext. input) that are external to the printer such as a computer, a scanner, a camera, a visual display unit, a personal data assistant, or other.

To print or emit a single drop of ink, an ink ejection element is uniquely addressed with a short pulse of current to rapidly heat a small volume of ink. This vaporizes a thin layer of the ink on the ink ejection element surface; the resulting vapor bubble expels a column of ink out of the orifice and towards the print medium. Alternatively, the ink ejection elements may include piezoelectric features, such as a flexing diaphragm, that emit ink drops by converting an electrical firing signal into a mechanical deflection of the diaphragm.

A control panel 581 having user selection interface 601 may also provide input 621 to the controller 571 to enable additional printer capabilities and robustness.

With reference to FIGS. 2A-2H, a substrate 10 with a plurality of ink ejection elements has formed thereon a first positive resist layer 14, especially a reverse imageable positive resist layer such as AZ 5214 available from Clariant Corporation. Preferably, but not required, the layer 14 becomes formed by either spin casting a solution or laminating a dry film of the positive resist material on a surface 13 (FIG. 1) of the substrate to a uniform thickness or depth of about 14 to about 16 microns. The process conditions under which this layer becomes formed includes spin casting between 2000 and 4000 r.p.m. followed by baking at a temperature of about below 100° C. Skilled artisans should appreciate that the foregoing materials, process conditions and thicknesses are merely a function of user preference and should not be used to limit the claim unless such limitations are found in the claim.

Once the first layer is formed, a photomask 16 having light passing regions 18 and non-light passing regions 20 is introduced between an energy source 22 and the substrate to expose desired areas 27 of the first positive resist layer to energy rays (arrows 24) while protecting an area 26 adjacent the ink ejection elements 12 from exposure. In a preferred embodiment, the energy source is an ultraviolet (UV) source operating at I-line frequencies for a period of about 3-20 seconds. In other embodiments, the energy source comprises deep UV radiation, electron rays, X-rays or the like.

Once exposed, the wafer is heated to a temperature sufficient to cross-link or otherwise render areas 27 insoluble. In a preferred embodiment, the heating occurs at a substantially constant temperature of about 175 degrees Celsius for a period of about 15 minutes. In other embodiments, the heating of the first positive resist layer occurs throughout a range of temperatures between 100 and 225 degrees Celsius or at a selected plurality of discrete temperatures in such range and all embodiments are embraced herein.

Figure 2A:
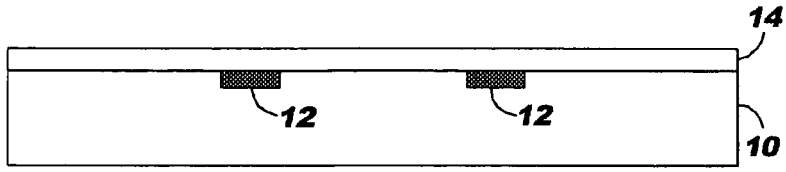
FIG. 2A is a diagrammatic cross-section view in accordance with the teachings of the present invention of an inkjet printhead wafer with a first positive resist layer in a processing step subsequent to FIG. 1.
Figure 2B:
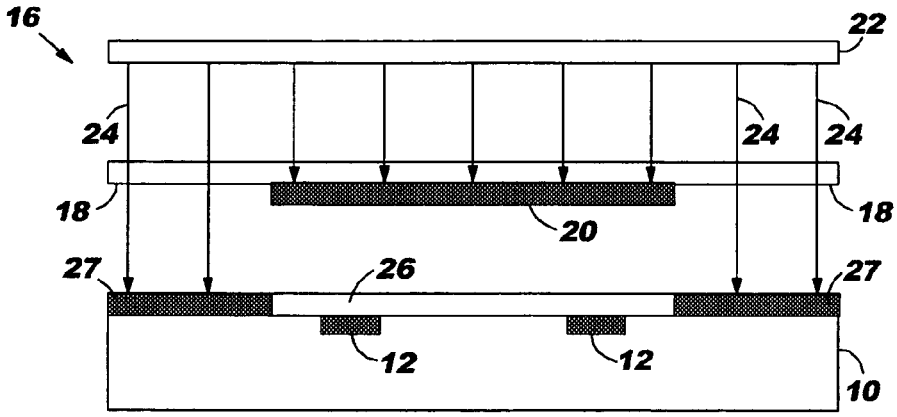
FIG. 2B is a diagrammatic cross-section view in accordance with the teachings of the present invention of a first exposure and photomasking step in a processing step subsequent to FIG. 2A.
Figure 2C:
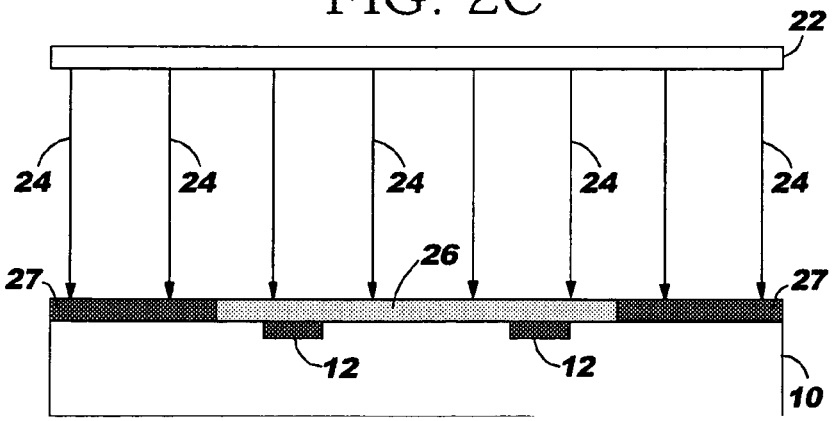
FIG. 2C is a diagrammatic cross-section view in accordance with the teachings of the present invention of a first blanket exposure step in a processing step subsequent to FIG. 2B.

In FIG. 2C, with the photomask 16 removed, an entirety of the first positive resist layer 14 (i.e., both areas 24 and 27) are exposed to energy rays 24 via a blanket energy exposure. In this manner, area 26 becomes structurally weakened (as indicated by the scattered marks) to facilitate later removal. Alternatively, a photomask that only exposes area 26 to energy rays may be used to protect areas 27 previously exposed to the energy.

Figure 2D:
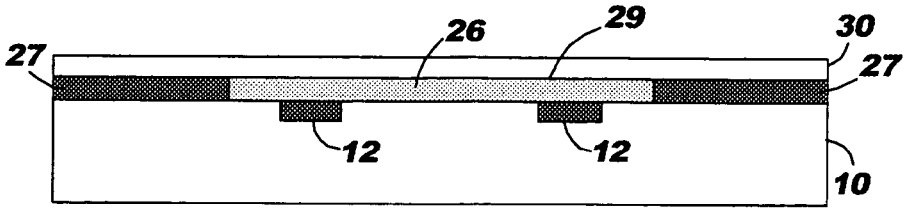
FIG. 2D is a diagrammatic cross-section view in accordance with the teachings of the present invention of an inkjet printhead wafer with a second positive resist layer in a processing step subsequent to FIG. 2C.

In FIG. 2D, a second positive resist layer 30 becomes formed on an upper surface 29 of the first positive resist layer. Preferably, but not required, the second positive resist layer 30 is formed to a substantially uniform thickness or depth by spin casting a solution or laminating a dry film of the second positive resist material to a thickness approximately the same thickness as the first positive resist layer. Preferred second positive resist materials include, but are not limited to, AZ 5214 available from Clariant Corporation. Similar to the first positive resist layer, the composition, process conditions and thickness are dictated by user preference or application.

Figure 2E:
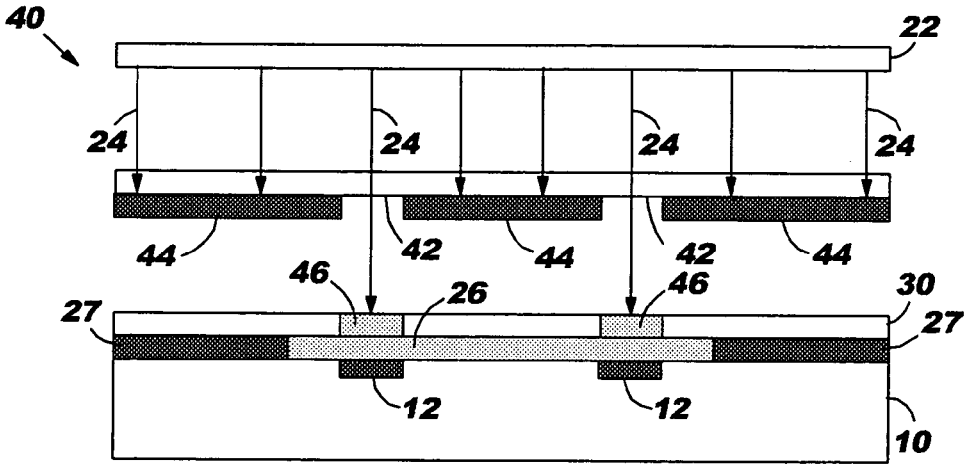
FIG. 2E is a diagrammatic cross-section view in accordance with the teachings of the present invention of a second exposure and photomasking step in a processing step subsequent to FIG. 2D.

In FIG. 2E, a second photomask 40 having light passing 42 and non-light passing regions 44 becomes inserted between the energy source 22 and the substrate to expose the second positive resist layer in accordance with the pattern of the second photomask. In a preferred embodiment, the photomask is configured such that a region 46 above the ink ejection element 12 is exposed to energy rays 24 from the energy source. In this manner, similar to the first positive resist layer, the second positive resist layer becomes weakened for subsequent removal.

Figure 2F:
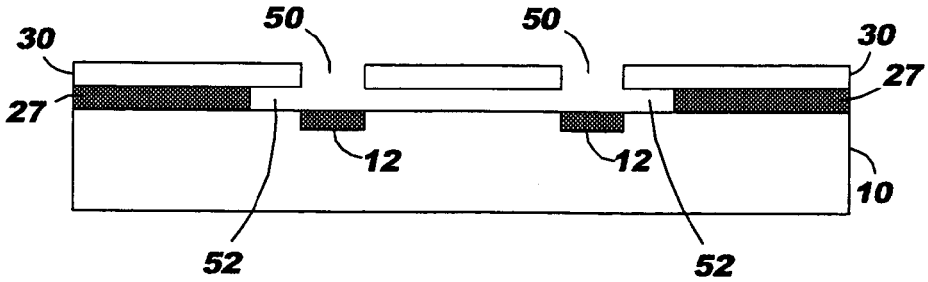
FIG. 2F is a diagrammatic cross-section view in accordance with the teachings of the present invention of a single removal step in a processing step subsequent to FIG. 2E.
Figure 2G:
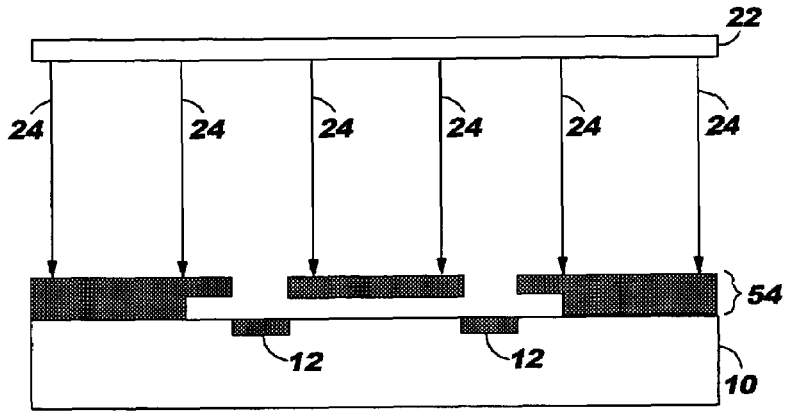
FIG. 2G is a diagrammatic cross-section view in accordance with the teachings of the present invention of a second blanket exposure step in a processing step subsequent to FIG. 2F.

In FIG. 2F, application of a suitable solvent develops the substrate by removing or stripping the region 46 of the second positive resist layer 30 and the area 26 of the first positive resist layer adjacent the ink ejection elements. What remains is a nozzle orifice 50 and a bubble chamber or other ink flow feature 52 above or around the ink ejection elements. Preferred solvents for this removal or stripping step include, but are not limited to, alkaline aqueous developers.

Skilled artisans will appreciate that the photomasks taught herein will have fiducials corresponding exactly to the fiducials of the photomasks used to fabricate the ink ejection elements 12 during previous processing steps such that the nozzle orifice 50 will have desirable and accurate alignment therewith.

Figure 2H:
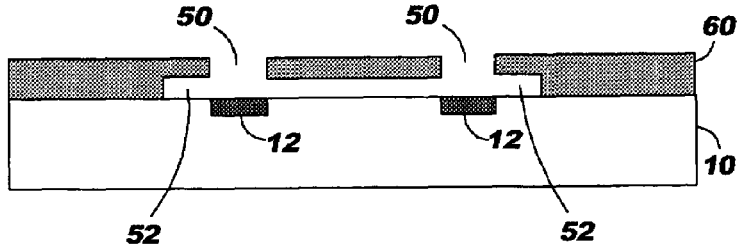
FIG. 2H is a diagrammatic cross-section view in accordance with the teachings of the present invention of an inkjet printhead wafer and nozzle plate in a processing step subsequent to FIG. 2G.

Further, skilled artisans will appreciate that the structure now remaining does not have a cross-linked second positive resist layer capable of use. Accordingly, in FIG. 2G, the remaining portions 54 of the first and second layers undergo a second blanket exposure or energy rays 24 from energy source 22. Thereafter, the substrate and layers are heated which completes the formation of the nozzle plate 60 on the substrate 10 as seen in FIG. 2H. The exposure and heating steps can be performed under conditions comparable to those already described. It should be appreciated that the finished nozzle plate may have any variety of shapes and cross-sections and should not be limited to that shown. Even further, the invention may include more than two positive resist layers and/or layers other than positive resists.

The foregoing description is presented for purposes of illustration and description of the various aspects of the invention. The descriptions are not intended to be exhaustive or to limit the invention to the precise form disclosed. The embodiments described above were chosen to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed:

1. An inkjet printhead, comprising:

a body; and a substrate with an ink ejection element bonded to said body having a nozzle plate formed concurrently therewith, said nozzle plate having two reverse imageable positive resist layers cured together defining a thickness thereof and being one of laminated and spin casted on a surface of said substrate, one of said two layers defining a nozzle orifice and another of said two layers defining one of a bubble chamber and an ink flow feature.

2. An inkjet printhead, comprising:

a body; and a substrate with an ink ejection element bonded to said body having a nozzle plate formed concurrently therewith, said nozzle plate having two reverse imageable positive resist layers cured together defining a thickness thereof, one of said two layers defining a nozzle orifice and another of said two layers defining one of a bubble chamber and an ink flow feature.

3. The printhead of claim 2, wherein said ink ejection element includes a resistor layer on said substrate having a composition of tantalum, aluminum and nitrogen.

4. The printhead of claim 2, wherein said thickness is about 28 to about 32 microns.

5. The printhead of claim 2, wherein said nozzle orifice is aligned with said ink ejection element in a direction away from said substrate.

6. The printhead of claim 2, wherein said bubble chamber is above said ink ejection element in a direction away from said substrate.

7. The printhead of claim 2, wherein said ink flow feature is above said ink ejection element in a direction away from said substrate.

8. An inkjet printhead, comprising:

a substrate with a plurality of ink ejection elements formed thereon; and two reverse imageable positive resist layers cured together on said substrate to define a nozzle plate thickness, an outermost layer of said two layers defining a nozzle orifice for each said plurality of ink ejection elements and an innermost layer of said two layers defining one of a bubble chamber and an ink flow feature for said each said plurality of ink ejection elements.

9. The inkjet printhead of claim 8, wherein said outermost layer has a thickness of about 14 to about 16 microns.

10. The inkjet printhead of claim 8, wherein said innermost layer has a thickness of about 14 to about 16 microns.

11. The inkjet printhead of claim 8, wherein said nozzle plate thickness is about 28 to about 32 microns.

12. The inkjet printhead of claim 8, wherein said innermost and outermost layers are able to withstand heating at temperatures in a range of about 100 to about 225 degrees Celsius.

13. The inkjet printhead of claim 8, wherein said innermost and outermost layers are able to withstand UV radiation at I-line frequencies.

14. The inkjet printhead of claim 8, wherein one of said innermost and outermost layers originally comprise a solution of positive resist material.

15. The inkjet printhead of claim 8, wherein one of said innermost and outermost layers originally comprise a dry film of positive resist material.

16. The inkjet printhead of claim 8, wherein said each said plurality of ink ejection elements includes a resistor layer of tantalum, aluminum and nitrogen composition.

17. The inkjet printhead of claim 16, wherein said resistor layer is about 900 to about 1000 angstroms.

18. The inkjet printhead of claim 8, further including a body to which said substrate is bonded.

19. The inkjet printhead of claim 18, further include a TAB circuit attached to both said body and said substrate.

20. The inkjet printhead of claim 8, wherein each said nozzle orifice is aligned with one of said plurality of ink ejection elements in a direction away from said substrate.

* * * * *